United States Patent [19]

Suganuma

[11] Patent Number: 5,062,401

[45] Date of Patent: Nov. 5, 1991

[54] FUEL SUPPLYING DEVICE FOR MARINE PROPULSION UNIT

[75] Inventor: Yasuo Suganuma, Hamamatsu, Japan

[73] Assignee: Sanshin Kogyo Kabushiki Kaisha, Hamamatsu, Japan

[21] Appl. No.: 616,648

[22] Filed: Nov. 21, 1990

[30] Foreign Application Priority Data

Nov. 22, 1989 [JP] Japan ..... 1-301905

[51] Int. Cl.[5] ..... F02B 77/08; F02D 41/22; F02P 11/02

[52] U.S. Cl. ..... 123/333; 123/335; 123/198 D

[58] Field of Search ..... 123/332, 333, 334, 335, 123/198 D, 198 DB, 198 DC

[56] References Cited

U.S. PATENT DOCUMENTS

| | | | |
|---|---|---|---|
| 3,370,580 | 2/1968 | Vnuk | 123/333 X |
| 4,198,933 | 4/1980 | Sieber et al. | 123/333 |
| 4,336,778 | 6/1982 | Howard | 123/335 X |
| 4,470,390 | 9/1984 | Omori et al. | 123/335 X |
| 4,741,306 | 5/1988 | Watanabe et al. | 123/198 DC X |
| 4,768,480 | 9/1988 | Green et al. | 123/198 DC X |
| 4,951,640 | 8/1990 | Hirukawa et al. | 123/198 DC X |
| 4,966,115 | 10/1990 | Ito et al. | 123/335 X |

*Primary Examiner*—Willis R. Wolfe
*Attorney, Agent, or Firm*—Ernest A. Beutler

[57] ABSTRACT

A fuel supplying device for a marine propulsion unit wherein the engine is slowed in response to an abnormal condition by interrupting the ignition. In order to prevent excess fuel consumption and preclude backfiring, the fuel supply is also discontinued when the ignition system is interrupted.

11 Claims, 4 Drawing Sheets

FUEL SUPPLYING DEVICE FOR MARINE PROPULSION UNIT

BACKGROUND OF THE INVENTION

This invention relates to a fuel supplying device for a marine propulsion unit and more particularly to an improved device for insuring that fuel will not be supplied to the engine during ,such times as the engine is being intentionally misfired so as to control its speed and to protect the engine.

It is known to provide ignition systems for internal combustion engines which intentionally misfire the ignition system and spark plugs so as to reduce the speed of the engine when certain conditions are sensed. For example, such misfiring may be done to protect the engine from damage due to over speed, over temperature, lack of cooling water, low oil pressure, low oil supply, or a wide variety of other functions or combinations of them. With most conventional systems, when the spark plug is intentionally misfired, fuel is still supplied to the engine. Not only does this waste fuel, but there is also a danger that backfiring may occur in the exhaust system due to the rich fuel mixture contained therein caused by the misfiring.

It is, therefore, a principal object of this invention to provide an improved engine protection system wherein the engine speed is reduced by misfiring and wherein the fuel supply is also stopped when the engine is being misfired.

It is a further object of this invention to provide an arrangement for avoiding the wastage of fuel at such times when the engine is being misfired.

It is a further object of this invention to provide an interrelated fuel and ignition control that prevents fuel from being supplied to the engine when the engine is being intentionally misfired.

SUMMARY OF THE INVENTION

This invention relates to a system for protecting an internal combustion engine having a fuel supply system and an ignition system. Means are provided for sensing an abnormal condition of the engine and for effecting misfiring of the ignition system when the abnormal condition is sensed to reduce the engine speed. Means responsive to the misfiring of the engine also stops the supply of fuel to the engine by the fuel supply system when the engine is being misfired.

DETAILED DESCRIPTION OF THE PREFERRED EMBODIMENTS

Figure 1:
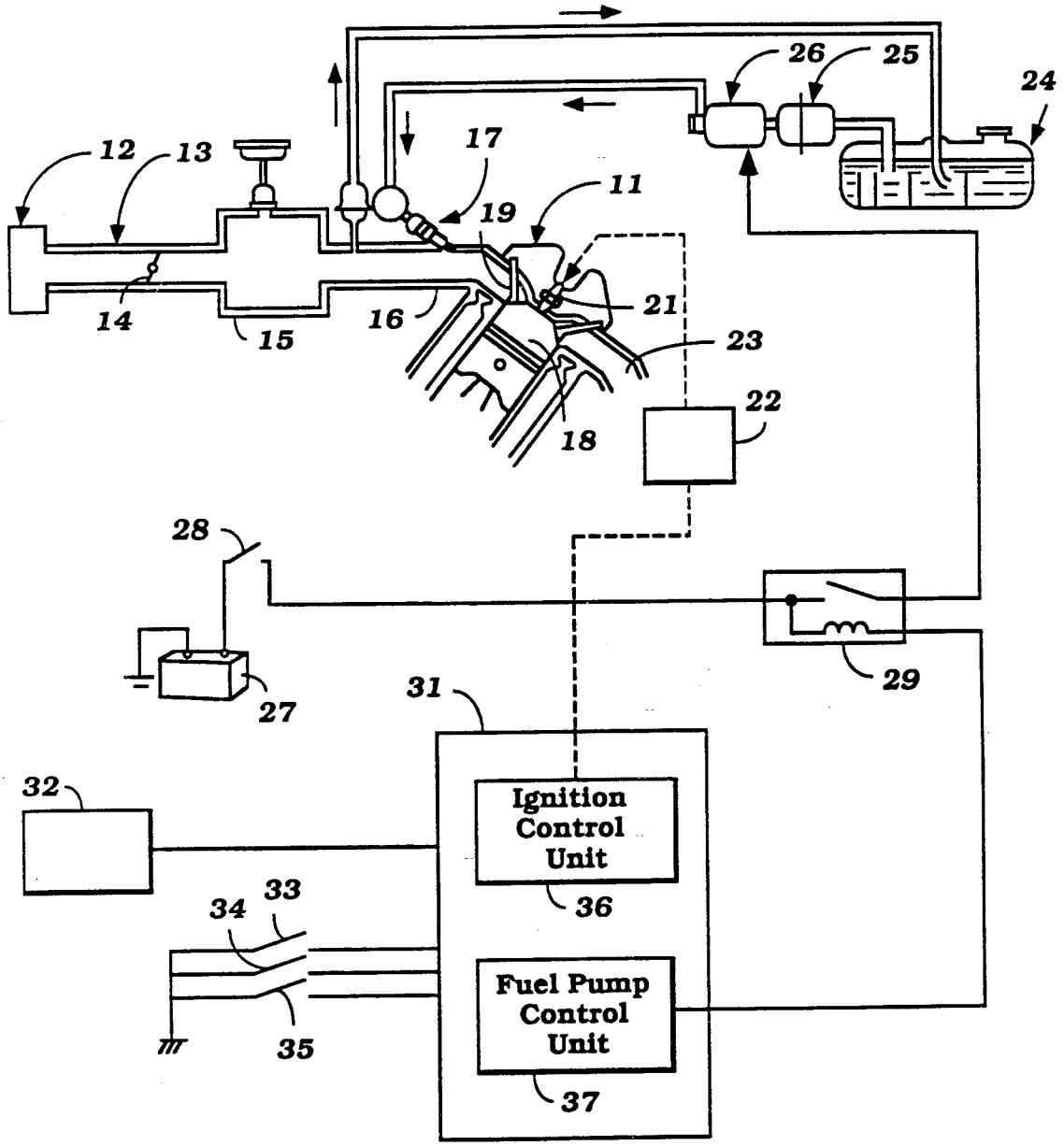
FIG. 1 is a partially schematic cross sectional view taken through an internal combustion engine having a fuel and ignition control constructed in accordance with an embodiment of the invention.

Referring first in detail to the embodiment of FIG. 1, an internal combustion engine constructed and operated in accordance with this embodiment of the invention is identified generally by the reference numeral 11. The engine 11 is depicted partially in cross section and shows a cross section through a portion of a single cylinder of the engine. The invention is described in conjunction with a reciprocating four cycle internal combustion engine. It is to be readily apparent, however, that the invention may be practiced with other types of engines and engines other than reciprocating engines. In addition, although the invention is described in conjunction with only a single cylinder of the engine, those skilled in the art will readily understand how the invention can be practiced with multi cylinder engines. The engine 11 is also utilized in conjunction with a marine propulsion system and may comprise the power unit of an outboard motor. Of course, the invention can be utilized in conjunction with other applications for internal combustion engines.

The engine 11 has an induction system comprised of an air inlet and silencing device 13 that delivers atmospheric air to a throttle body 13 in which a flow controlling throttle valve 14 is provided. A plenum chamber 15 is positioned downstream of the throttle body 14 and delivers air to an intake manifold 16 of the engine. A fuel injector 17 of the electronically controlled type is positioned in the manifold 16 for delivering a fuel charge to the combustion chamber 18 through an intake valve 19 in a known manner.

This charge is then fired by a spark plug 21 which is controlled by an ignition circuit 22. The burnt charge is then exhausted through an exhaust passage 23 and exhaust system (not shown) for discharge to the atmosphere.

Fuel is supplied to the fuel injector 17 from a remotely positioned tank 24 through a conduit in which a fuel filter 25 and fuel pump 26 are positioned.

The fuel pump 26 is electrically controlled and is powered by a battery 27 through a main switch 28 and relay switch 29. As will be noted, the relay switch 29 is operated in response to certain conditions so as to stop the fuel flow. The relay switch 29 is, however, normally closed when the engine is operating under normal running conditions.

In accordance with a feature of the invention, the engine 11 is provided with a protective device, indicated generally the reference numeral 31 which cooperates to control both the ignition circuit and the fuel pump 26 for providing a decrease in engine speed under certain abnormal conditions and also so as to prevent the supply of fuel to the engine at such times as the engine ignition system is being misfired so as to reduce the engine speed. This protective device 31 includes a number of control inputs including an engine speed indicator 32, a cooling water temperature sensor 33 that senses when the temperature of the cooling water exceeds a predetermined safe value, a cooling water volume sensor 34 which senses when the volume of cooling water flowing to the engine is below the minimum required and an oil pressure sensor 35 that senses the oil pressure to the engine. The outputs from all of these sensors 32 through 35 are outputted to the protection unit 31.

The protection unit 31 includes an ignition control unit 36 which will reduce the speed of the engine by misfiring the ignition circuit 22 under abnormal conditions and a fuel pump control circuit 37 which will operate the fuel pump relay 29 so as to shut this relay off and open the switch, thus preventing the operation of the fuel pump 26 when the ignition is being misfired.

Figure 2:
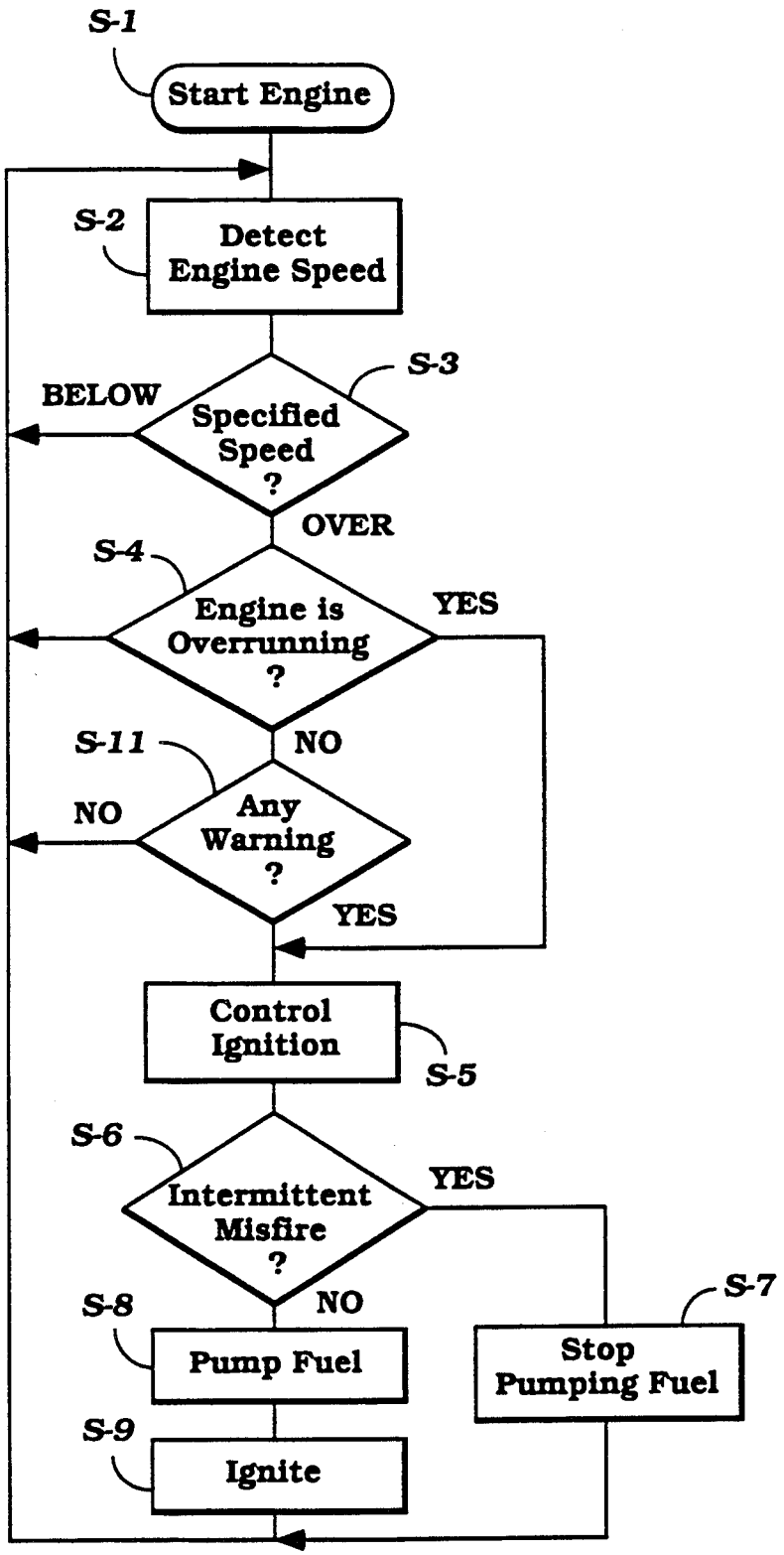
FIG. 2 is a block diagram showing the control routine of this embodiment.

The control routine for this system is shown in FIG. 2. The control routine begins at the step S-1 when the engine is started and then moves to the step S-2 to detect the actual running speed as sensed by the sensor 32. At the step S-3 the control unit 31 determines if the engine speed is above a predetermined speed which is low enough that misfiring is not required to protect the engine. If the speed is below that speed, the program exits and returns to start. If, however, the engine is operating above the predetermined speed, the program then moves to the step S-4 to determine if the actual speed of operation is above the safe speed of the engine. If it is, the program then moves to the step S-5 wherein the control unit 36 is activated so as to cause intermittent misfiring of the engine so as to reduce the engine speed. The program then moves to the step S-6 to determine that there is, in fact, a misfiring condition. If there is during the control, the program moves to the step S-7 so as to open the relay switch 29 and discontinue operation of the fuel pump 26 so as to insure that fuel will not be supplied to the engine at such times as the spark plug 21 is being misfired. This will prevent excess fuel consumption and backfiring, as aforenoted.

If, however, at the step S-6 the program determines that the spark 21 is not being misfired at that instance, then the program moves to the step S-8 so as to permit the relay 29 to be activated and to operate the fuel pump 26. The program then moves to the step S-9 so as to cause ignition through the ignition circuit 22.

Returning again to the step S-4, if it has been determined at this step that there is not an engine speed over condition, the program then moves to the step S-11 to determine if any of the warning switches 33, 34 and 35 have been closed, indicating an abnormal condition of the engine. If there have not been any conditions noted, the program then continues through the normal ignition cycle.

If, however, one or more of the warning switches 33, 34, 35 have been closed, then the program again moves to the step S-5 so as to control the engine speed by causing misfiring. If misfiring is being accomplished, the fuel pump is stopped at the step S-7, as aforenoted. Therefore, it should be readily apparent that this embodiment is effective so as to not only protect the engine in the event of an abnormal condition by reducing its engine speed, but also to reduce fuel consumption and the likelihood of backfiring by precluding the discharge of fuel under conditions when the engine is being deliberately misfired.

Figure 3:
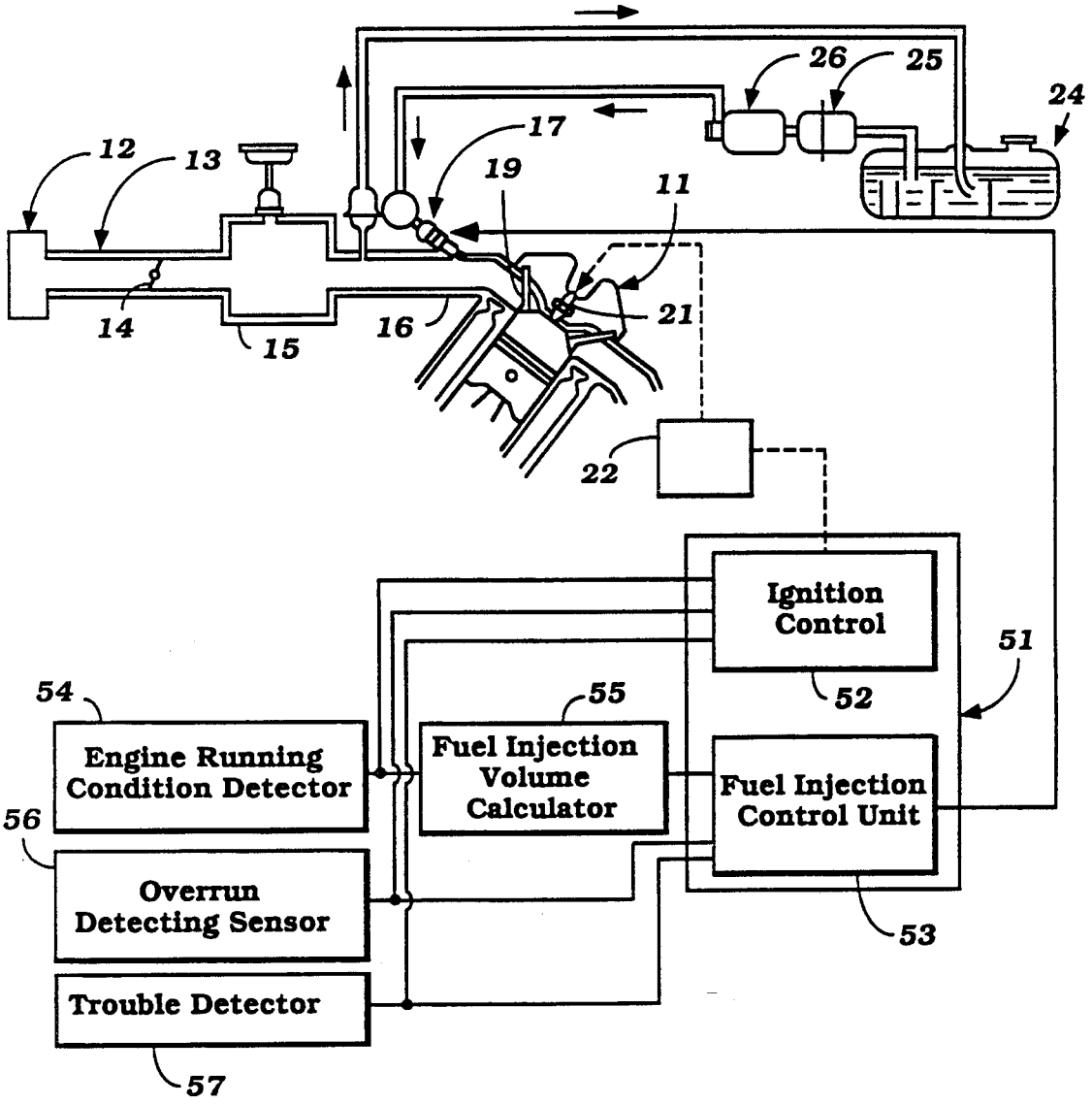
FIG. 3 is a partially schematic cross sectional view showing another embodiment of the invention.
Figure 4:
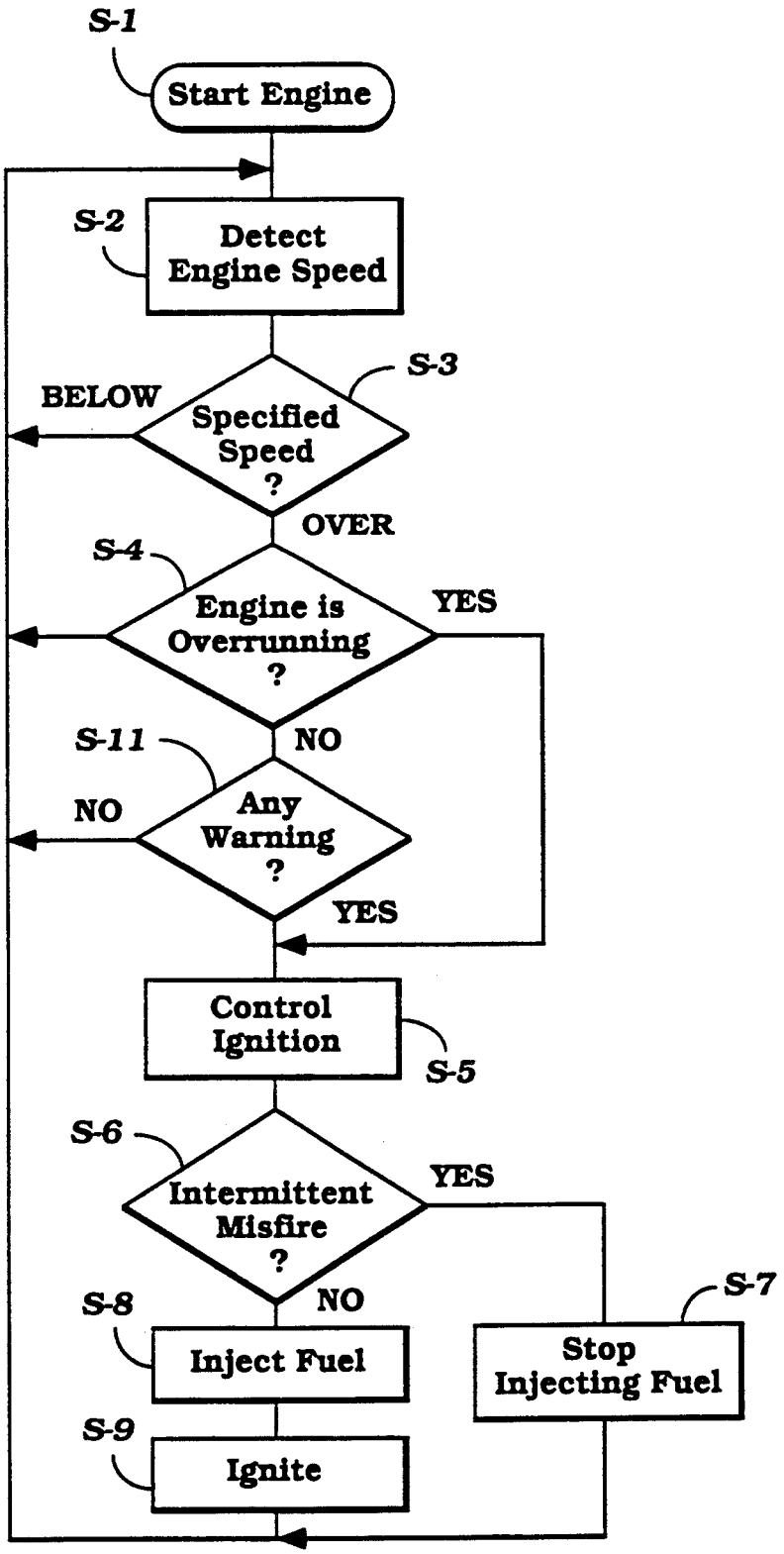
FIG. 4 is a block diagram showing the control routine for this embodiment.

In the embodiment of the invention as thus far described, the fuel supply has been stopped by discontinuing the operation of the fuel pump 26 that supplies fuel to the injector 17. As has been previously noted, the injector 17 is of the electrically operated type and the fuel control may be achieved by discontinuing the operation of the fuel injector 17 at the time when the spark plug 21 is being misfired. FIGS. 3 and 4 show such an embodiment.

In this embodiment, the fuel injection control unit is provided as a portion of a main control unit, indicated generally by the reference numeral 51 which control unit includes an ignition control 52 for controlling the ignition circuit 22 and a fuel injection control 53 for controlling the operation of the fuel injector 17 in a known manner.

The controls 51 receive a number of input signals including a wide variety of engine running condition detectors 54 which may include speed detectors, ,air flow detectors, temperature detectors and the like. These running conditions sensed by the detectors 54 are transferred to a fuel injection volume control detector 55 which outputs a signal to the fuel injection control unit 53 so as to control the amount and timing of the fuel injection in any type of known sequence. There are also provided a pair of trouble detectors including an engine over speed detector 56 that senses an engine over speed condition and an abnormal running condition detector 57 that senses any of a plurality of running condition difficulties such as engine temperature, cooling water volume or oil pressure, as in the previously described embodiment.

In the event of over speed or any of the other troubles, the engine speed is reduced by the ignition control 52 misfiring the ignition system 22 and, at the same time, preventing fuel injection by preventing actuation of the fuel injector 17 by the injection control unit 53. The control routine by which this is operated may be understood by reference to FIG. 4.

The steps in this control routine are the same as the steps in the control routine of FIG. 2, however, the actual controls may vary as will be noted. That is, the engine is started at the step S-1 and the engine speed is detected at step S-2. If the engine speed is determined to be under the predetermined minimum speed, the program exits and returns to the start. If, however, the speed is above the predetermined speed, the program moves to the step S-4 to determine if the engine speed is above a safe speed. If it is, the program moves to the step S-5 to initiate ignition control by causing intermittent firing at the step S-6. At the step S-7, instead of stopping the fuel pump 26, the injector 17 is not activated by the injection control unit 53 when the spark plug 21 is not being fired. However, if the spark plug is being fired, then the injector is operated at the step S-8 and the plug is fired at the step S-9.

As with the previously described embodiment, if, at the step S-4 it is determined that the engine is not in an over speed condition, the program then moves to the step S-11 to determine if any of the warning conditions sensed by the trouble detector 57 have been experienced. If not, normal ignition and fuel injection is followed. If, however, a warning condition is present, then the program again moves to control the engine speed by misfiring the ignition or spark plug 21 and, at the same time, preventing fuel flow by disabling actuation of the fuel injector 21.

It should be readily apparent from the foregoing description that the preferred embodiments of the invention are not only effective in protecting the engine against damage by reducing its speed by misfiring the spark plugs in the event of an abnormal condition, but also fuel economy and backfiring are controlled by preventing the discharge of fuel at such times as the spark plug is not being fired. Although two embodiments of the invention have been illustrated and described, various changes and modifications may be made without departing from the spirit and scope of the invention, as defined by the appended claims.

I claim:

1. An internal combustion engine having an ignition system for initiating combustion in a combustion chamber a fuel system for supplying fuel to said combustion chamber, means for detecting an abnormal engine condition, means for slowing the speed of said engine in response to the detection of an abnormal condition by misfiring of the ignition means, and means for precluding the flow of fuel to the engine from said fuel system when ignition is interrupted.

2. An internal combustion engine as set forth in claim 1 wherein the abnormal engine condition is an over speed condition.

3. An internal combustion engine as set forth in claim 1 wherein the abnormal engine condition is an over temperature condition.

4. An internal combustion engine as set forth in claim 1 wherein the abnormal engine condition is a low oil pressure condition.

5. An internal combustion engine as set forth in claim 1 wherein the abnormal condition is a lack of cooling water for a liquid cooling system for the engine.

6. An internal combustion engine as set forth in claim 1 wherein the fuel supply is discontinued by discontinuing the operation of a fuel pump.

7. An internal combustion engine as set forth in claim 1 wherein the fuel supply is interrupted by interrupting the operation of a fuel injector of the engine.

8. An internal combustion engine as set forth in claim 1 wherein a plurality of abnormal engine conditions are sensed and one is an over speed condition.

9. An internal combustion engine as set forth in claim 1 wherein a plurality of abnormal engine conditions are sensed and one is an over temperature condition.

10. An internal combustion engine as set forth in claim 1 wherein a plurality of abnormal engine conditions are sensed and one is a low oil pressure condition.

11. An internal combustion engine as set forth in claim 1 wherein a plurality of abnormal conditions are sensed and one is a lack of cooling water for a liquid cooling system for the engine.

* * * * *